United States Patent [19]

Goebel et al.

[11] 4,176,407

[45] Dec. 4, 1979

[54] HITTING MITT

[76] Inventors: Bert Goebel, 5466 Granada Way; Leo Perez, 5321 Ogan Rd., both of Carpinteria, Calif. 93013

[21] Appl. No.: 894,743

[22] Filed: Apr. 10, 1978

[51] Int. Cl.[2] ..... A41D 13/08

[52] U.S. Cl. ..... 2/20; 2/161 A

[58] Field of Search ..... 2/159, 160, 161 A, 161 R, 2/16, 20; 273/54 B

[56] References Cited

U.S. PATENT DOCUMENTS

| | | | |
|---|---|---|---|
| 3,066,306 | 12/1962 | Thomas | 2/20 |
| 3,146,463 | 9/1964 | Wargo | 2/20 |

FOREIGN PATENT DOCUMENTS

| | | | |
|---|---|---|---|
| 562670 | 5/1958 | Belgium | 2/161 R |
| 21188 | of 1914 | United Kingdom | 2/16 |

*Primary Examiner*—Dorsey Newton

*Attorney, Agent, or Firm*—Ralph B. Pastoriza

[57] ABSTRACT

The hitting mitt comprises a flexible pad structure formed into a tube shape having opposite end openings and including a hole formed through the side wall of the tube shape. A person can insert either his right or left hand into one of the end openings and orient the tube shape so that his thumb can extend through the hole with his fingers extending out the opposite end opening, the pad covering both the palm and back of his hand. The hitting mitt provides protection while playing volleyball, four square, tether ball and many other games.

4 Claims, 5 Drawing Figures

HITTING MITT

This invention relates generally to gloves used in various sports and games and more particularly to a specially designed hitting mitt which may be worn or either hand or both hands of a player for use in games, for example, such as volleyball, tether ball and the like.

BACKGROUND OF THE INVENTION

Many games and sports involve hitting a ball with one or both hands. While various types of gloves to be worn during game or sporting activities are known in the art, they generally follow the lines of conventional gloves, one being designed for the right hand and one for the left hand. Further, they normally do not include any type of protective padding except to the extent of providing heat insulation such as in hockey gloves.

In certain games such as volleyball or tether ball wherein the ball itself is normally struck by the palm of a player's hand, there is need for some type of protective mitt or device which will not only protect the palm but also the back of the wearer's hand particularly in the case of volleyball, all without impeding the use of the player's fingers and thumb. For simplicity in use and economical design, such a mitt should be capable of readily being worn by either a right or left-handed player.

BRIEF DESCRIPTION OF THE PRESENT INVENTION

With the foregoing considerations in mind, the present invention contemplates a glove or mitt meeting the foregoing desirable characteristics.

More particularly, the mitt of this invention comprises pad means formed into a tube shape having opposite end openings and including a hole formed through the side wall of the tube shape. With this arrangement, a person can insert either his right or left hand into one of the end openings and orient the tube shape so that his thumb can extend through the hole with his fingers extending out the opposite end opening. The pad means itself covers both the palm and back of the player's hand.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
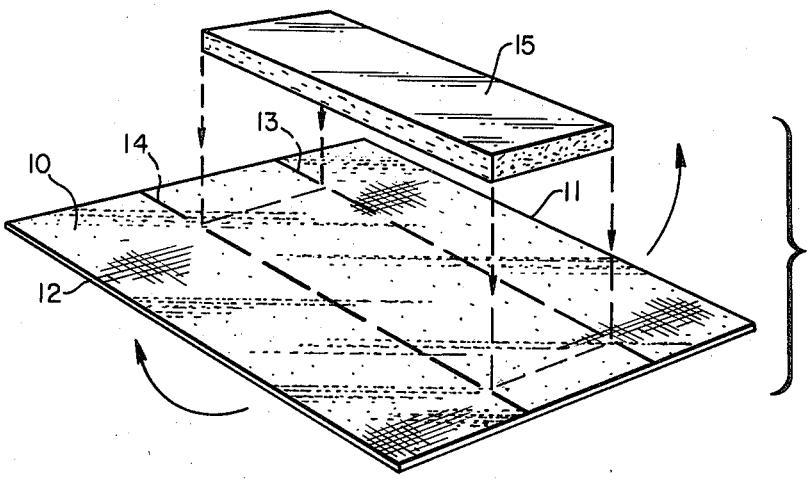
FIG. 1 is an exploded perspective view illustrating the basic components utilized in making up the hitting mitt of this invention.

Referring first to FIG. 1, the hitting mitt in accord with this invention is made up of a rectangular piece of cloth 10 having its longitudinal edges 11 and 12 foldable along longitudinal fold lines 13 and 14 respectively. These fold lines are located approximately one third the width of the cloth inwardly from the longitudinal edges 11 and 12 as shown.

A rectangular pad of foam 15 shown exploded above the cloth 10 has a width approximately one third the width of the cloth and is arranged to be received on the central portion of the cloth so that the pad is enclosed upon folding over of the longitudinal edges of the cloth. This folding is indicated by the curved arrows in FIG. 1.

Figure 2:
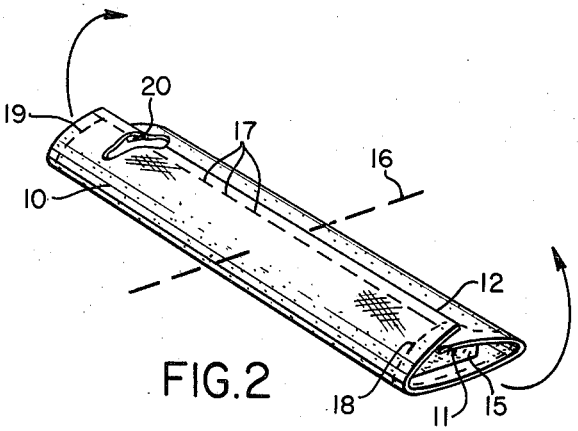
FIG. 2 illustrates in perspective subsequent steps in making up the hitting mitt.

Referring now specifically to FIG. 2, the components of FIG. 1 are shown in their positions after folding over of the longitudinal edges 11 and 12 as described. The arrangement is such that a further fold can be made about a transverse fold line 16 approximately at a midpoint of the cloth to bring the opposite ends of the cloth together. This latter folding operation is indicated by the curved arrows adjacent the opposite ends as shown in FIG. 2.

Prior to the subsequent folding described above, stitching is provided through the longitudinal edges as indicated at 17 and in the particular embodiment described, this stitching extends entirely through the encased foam pad 15 to the opposite side of the cloth. Further, the folded ends of the cloth illustrated in FIG. 2 are stitched as indicated at 18 and 19 respectively.

At this point in the making up of the hitting mitt, there may be provided a hole 20 at a mid area adjacent one end such as the end stitching 19 of the folded cloth, the purpose of which will become clearer as the description proceeds.

Figure 3:
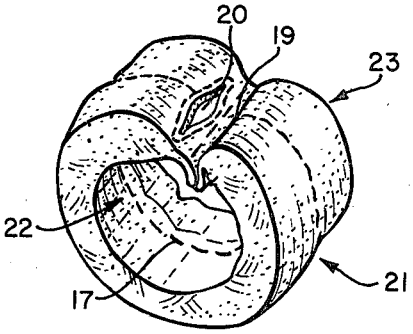
FIG. 3 shows the completed hitting mitt in perspective view.

Referring now to FIG. 3, the subsequent folding about the fold line 16 described in FIG. 2 results in a bringing of the stitched portions 18 and 19 of the ends of the folded cloth together to form a tube shape designated generally by the arrow 21 in FIG. 3. It will be understood, of course, that the end portions with the stitching 18 and 19 are in turn stitched together to hold the cloth and pad in the tube shape shown.

When formed as illustrated in FIG. 3, the tube shape has opposite openings designated by the arrows 22 and 23 and the hole 20 formed adjacent the one end provides communication with the interior of the tube shape.

OPERATION

Figure 4:
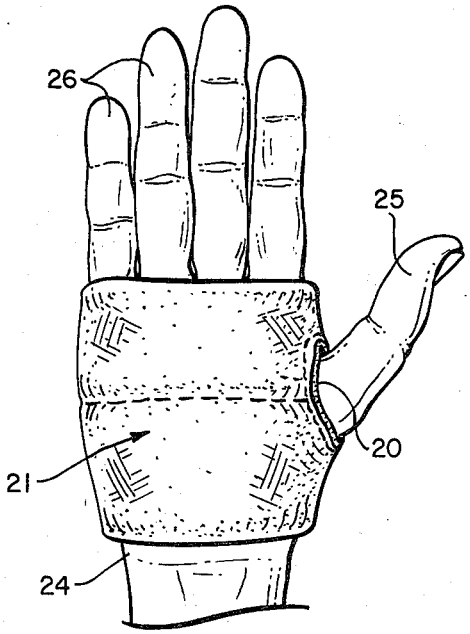
FIG. 4 is a front elevational view of a person's right hand wearing the hitting mitt of FIG. 3; and, FIG. 5 illustrates a person's left hand wearing the same hitting mitt illustrated in FIGS. 3 and 4.

In using the hitting mitt as described in FIGS. 1, 2 and 3, a person can insert his right hand shown at 24 in FIG. 4 into one of the end openings described in FIG. 3 with his right thumb extending through the hole 20 as shown at 25 and his fingers extending out the opposite end opening as shown at 26. As illustrated in FIG. 4, the cloth and pad cover both the palm and back of the hand because of the tube shape described in FIG. 3. In other words, both the palm and back of the hand are protected by the encircling cloth and pad.

Figure 5:
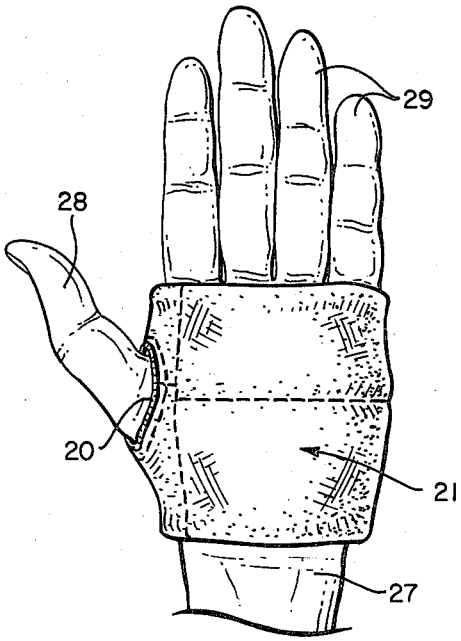

Moreover, the tube shape can be rotated about the tube axis 180° to locate the hole 20 on an opposite side such as illustrated in FIG. 5. When so oriented, a person can insert his left hand shown at 27 in FIG. 5 into the one end opening of the tube shape with his left thumb 28 extending through the hole 20 and his fingers extending out the opposite end opening as shown at 29. Again, both the palm and back of the hand are protected by the encircling cloth and pad.

The stitching 17 shown in FIGS. 2 and 3 as stated preferably extends entirely through the longitudinal edges, foam pad and opposite surface of the cloth to thoroughly anchor the pad 15 in place. This stitching is visible in FIGS. 4 and 5.

Further, by locating the hole 20 described in FIG. 2 in the central end area as shown in FIG. 2 or in a position approximately midway between the opposite end openings as shown in FIG. 3, the tube shape is essentially symmetrical on either side of the stitching 17 so that a person can insert either hand in either end opening 22 or 23 of the tube shape.

From all of the foregoing, it will thus be evident that a very simple, inexpensive yet highly useful glove type hitting mitt is provided which can readily be worn on either hand for protecting the palm and back area without impeding the use of the person's fingers and thumbs.

What is claimed is:

1. A hitting mitt including a generally rectangular shaped pad; a cloth covering encasing said pad, said pad and cloth covering being folded about a transverse fold line mid-way of the rectangular shaped pad to form a tube shape; and stitching means securing the pad and cloth in said tube shape, said tube shape having opposite end openings and including a hole formed through the side wall of the tube shape, whereby a person can insert either his right or left hand into one of the end openings and orient said tube shape so that his thumb can extend through said hole with his fingers extending out the opposite end opening, the pad covering both the palm and back of his hand.

2. A hitting mitt according to claim 1, in which said hole is positioned approximately midway between said opposite end openings.

3. A hitting mitt, comprising, in combination:

(a) a rectangular cloth having its longitudinal edges foldable along longitudinal fold lines located approximately one third the width of the rectangular cloth inwardly from said longitudinal edges, and thence foldable about a transverse fold line at approximately a mid-point of the rectangular cloth to bring the opposite ends of the cloth together;

(b) a rectangular pad of foam of width approximately one third the width of the cloth receivable on the central portion of the cloth so that said pad is enclosed upon folding over of said longitudinal edges of the cloth; and, (c) stitching passing through said longitudinal edges to hold them together, and through the opposite ends of the cloth when brought together, to form the cloth and pad into a tube shape, a mid-area adjacent one end of the folded cloth being provided with a hole communicating with the interior of said tube shape, whereby a person can insert his right hand into one end opening of said tube shape with his right thumb extending through said hole and his fingers extending out the opposite end opening, both the palm and back of the hand being protected by the encircling cloth and pad, and whereby the tube shape can be rotated about the tube axis 180° to locate said hole on an opposite side so that a person can insert his left hand into said one end opening of said tube shape with his left thumb extending through said hole and his fingers extending out the opposite end opening, both the palm and back of the hand again being protected by the encircling cloth and pad.

4. A hitting mitt according to claim 3, in which the stitching of the longitudinal edges of the cloth together extends entirely through said pad and opposite cloth portion so that said pad is anchored in position in said cloth, said tube shape being essentially symmetrical on either side of said stitching of said longitudinal edges so that a person can insert his hand in either end opening of the tube shape.

* * * * *